US006387219B2

(12) United States Patent
Snellman

(10) Patent No.: US 6,387,219 B2
(45) Date of Patent: May 14, 2002

(54) PRESS DEVICE HAVING AN EXTENDED PRESS NIP FOR PRESSING A TRAVELING PAPER OR PAPERBOARD WEB

(75) Inventor: Jorma Snellman, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/734,311

(22) Filed: Dec. 11, 2000

Related U.S. Application Data

(60) Provisional application No. 60/172,531, filed on Dec. 17, 1999.

(30) Foreign Application Priority Data

Dec. 10, 1999 (SE) ..... 9904537-9

(51) Int. Cl.[7] ..... D21F 3/06
(52) U.S. Cl. ..... 162/358.3; 162/361; 100/153
(58) Field of Search ..... 162/358.3, 358.5, 162/361; 100/153, 162 B; 492/20, 7

(56) References Cited

U.S. PATENT DOCUMENTS 4,917,768 A * 4/1990 Ilmarinen ..... 162/358.3
5,650,047 A * 7/1997 Meschenmoser ..... 162/358.3
6,083,352 A * 7/2000 Snellman et al. ..... 162/358.3

* cited by examiner

*Primary Examiner*—Karen A. Hastings
(74) *Attorney, Agent, or Firm*—Alston & Bird LLP

(57) ABSTRACT

An extended-nip press device comprises a press shoe extending in a cross-machine direction and a support for supporting the press shoe. Between the shoe and the support are arranged a plurality of loading cylinders for moving the shoe toward a backing member such as a counter roll to apply pressure to a fibrous web passing through the nip between the shoe and counter roll. Each loading cylinder comprises a first cylinder member fixed on the shoe and a second cylinder member fixed on the support, and a connecting member that slidably engages both cylinder members. The connecting member can slide relative to the first cylinder member with a first stroke length L1 that is smaller than the stroke length L2 between the connecting member and the second cylinder member. Accordingly, the connecting member can remain essentially aligned along the lengthening direction of the loading cylinder.

14 Claims, 4 Drawing Sheets

PRESS DEVICE HAVING AN EXTENDED PRESS NIP FOR PRESSING A TRAVELING PAPER OR PAPERBOARD WEB

CROSS-REFERENCE TO RELATED APPLICATION

The present application claims the benefit of the filing date of U.S. Provisional Patent Application No. 60/172,531, filed Dec. 17, 1999.

FIELD OF THE INVENTION

The present invention relates to a press device having an extended nip intended for pressing a running paper or paperboard web. More specifically, the invention relates to a shoe press of the type which comprises a support which supports a press shoe adjacent to a counter roll or another backing member in such a way that the press shoe and the backing member form an extended nip therebetween, and which also comprises a hydraulic or pneumatic arrangement for urging the press shoe toward the backing member in order to apply a pressure on the web passing through the nip.

The press device according to the invention particularly advantageously can be utilized for wet-pressing of moist paper or paperboard webs, but also for calendering or other finishing of dried paper or paperboard. The press device according to the invention can also be utilized for fiber webs other than paper and paperboard.

BACKGROUND OF THE INVENTION

Shoe press devices, i.e. presses having an extended nip, have been employed for many years when manufacturing different paper and paperboard grades, primarily for wet-pressing in order to increase the dryness of the web, but also for calendering and other finishing in order to improve surface properties or other physical properties of the web.

As a result of their longer nips, shoe press devices provide a number of advantages in comparison to conventional roll presses, such as a higher dryness at the same nip pressure, or the ability to press at a lower at nip pressure while maintaining the same dryness, which is more gentle to the sheet.

U.S. Pat. No. 4,917,768 discloses a shoe press device in which the press shoe is supported via tubular sleeves rigidly affixed to and spaced apart on a support in a direction across the machine direction. The sleeves are received in cylindrical recesses in the press shoe in order to allow the press shoe to move toward or away from a counter roll such that the nip pressure can be varied. The disclosed shoe press comprises hydraulic jacks upstream and downstream of the sleeves for forcing the press shoe against the counter roll and for pivoting the shoe about an axis that extends in the cross-machine direction in order to vary the nip pressure in the machine direction. The sleeves fit somewhat loosely in the recesses in the shoe, and a resilient seal encircles each sleeve for sealing the interface between the sleeve and the recess. Accordingly, the press shoe of the shoe press disclosed in U.S. Pat. No. 4,917,768 is capable of pivoting relative to the support for varying the nip pressure in the machine direction.

However, it has been found that such shoe presses can be associated with certain problems. One such problem originates from the thermal expansion of the press shoe, which is a result of the heat generated by friction against the belt that runs over the press shoe and carries the paper or paperboard web through the press and by the hot hydraulic fluid which for different reasons is circulated through the shoe. The thermal expansion of the press shoe results in an elongation of the shoe in the cross-machine direction, which creates bending tensions in the support and hydraulic arrangement of the press shoe, which of course is undesirable.

In EP 0 933 471, corresponding to U.S. Pat. No. 6,083,352, the disclosure of which is incorporated herein by reference, a shoe press is disclosed which reduces the problems originating from the thermal expansion of the press shoe, since it has the ability to tolerate relatively large elongations of the press shoe across the machine direction, and also other deformations of the press shoe. The disclosed shoe press comprises a press shoe extending in the cross-machine direction along the entire width of a web running through the press, and a plurality of articulated hydraulic loading cylinders supported by a support and spaced apart along the shoe. The loading cylinders define working chambers which are pressurizable by hydraulic fluid, so as to enable the cylinders to urge the press shoe away from the support and toward a counter roll or other backing member for applying pressure to the web being carried through the nip defined between the shoe and the backing member. Each loading cylinder comprises a piston member disposed within a cylinder member. Either the piston or the cylinder comprises a two-part member having a first member fixed relative the press shoe and a second member fixed relative to the support, while the remaining piston or cylinder comprises a coupler.

In a preferred embodiment of the shoe press according to EP 0 933 471, the two-part member consists of first and second cylinders, while the coupler comprises a piston which is slidably received in the two cylinders. In an alternative preferred embodiment the two-part member instead comprises first and second pistons, while the coupler comprises a cylinder which surrounds both pistons.

The coupler of the shoe press disclosed in EP 0 933 471 sealingly engages at least one of the members, so that the first member is urged away from the second member in a loading direction when pressurizing the working chamber to cause the press shoe to be urged towards the backing member. In order to enable the loading cylinders to accommodate elongation of the press shoe across the machine direction, each coupler engages the respective first and second members at seals which enable the coupler to pivot relative to the first and second members about axes parallel to the machine direction. Accordingly, the press shoe is free to expand thermally in the cross-machine direction without causing bending of any piston and/or cylinder members of the loading cylinders.

Since the press shoe of the shoe press disclosed in EP 0 933 471 also can move or pivot in the machine direction relative to the support, the shoe press includes a stopping means which restricts the movement of the shoe forward in the machine direction.

In order to control the conditions in the nip of a shoe press, such as the pressure profile through the nip, it is usually desirable to be able to move the press shoe forward or backwards in the machine direction in order to be able to influence the pressure profile through the nip so that the nip pressure is highest in the beginning and lower in the end of the nip, or vice versa. When performing such a regulation of the pressure profile through the nip, the press shoe, in principle, will follow an arc-shaped path having its center at the central axis of the counter roll. This may result in a skewness in the machine direction between the parts included in the loading cylinders, i.e. between piston and cylinders or between pistons and cylinder. Such a skewness can generate forces both on the cylinder and on the shoe, which forces are directed in the machine direction or against the machine direction, depending on the direction of the skewness. If the skewness of the connecting member in a direction away from a possible stopping means (shoe support) is large enough, these forces may exceed the force directed towards the support, resulting in instability. If the connecting member is tilted in a direction toward the shoe support, forces which are directed toward the shoe support are generated, which increases the stresses on the shoe support.

Also in case a paper lump or the like unintentionally enters the nip, similar skewnesses can be generated and cause stresses on a shoe support.

SUMMARY OF THE INVENTION

Accordingly, the present invention provides a press device having an extended nip for pressing a running paper or paperboard web in which the press shoe unintentionally or intentionally can be tilted/pivoted around an imaginary axis across the machine direction with minimum skewness between the parts included in the loading cylinders, and without generating any excessively large forces directed towards a possible shoe support or the press shoe becoming unstable if the forces are directed against the machine direction (away from a possible shoe support).

In accordance with one preferred embodiment of the invention, a press device comprises a press shoe aligned across the machine direction and arranged for forming an extended nip in cooperation with a backing member for passage of the web therethrough, a support which movably supports the press shoe such that the shoe is movable toward and away from the backing member via a plurality of loading cylinders spaced apart along the press shoe for enabling application of pressure on the web during pressing. Each of the loading cylinders comprises a first cylinder member fixed on the press shoe, a second cylinder member fixed on the support, and a connecting member slidably engaged with and extending between the first and second cylinder members. The connecting member and the first cylinder member are slidable in relation to each other with a first length of stroke L1, and the connecting member and the second cylinder member are slidable in relation to each other with a second length of stroke L2. The connecting member has a length L3 in a direction corresponding to that along which the connecting member is slidable in relation to the first and second cylinder members. In accordance with the invention, the first length of stroke L1 is smaller than the second length of stroke L2.

Preferably, the first length of stroke L1 is less than half of the second length of stroke L2. Furthermore, it is preferred that the length L3 of the connecting member be larger than both the first length of stroke L1 and the second length of stroke L2. In one embodiment, the length L3 of the connecting member is larger than the sum of the first length of stroke L1 and the second length of stroke L2.

In accordance with a preferred embodiment of the invention, the connecting member sealingly engages the first and second cylinder members by contacting seals arranged between the connecting member and each of the cylinder members so as to form at least one working chamber within which pressure of a pressurizing medium can be increased in order to cause a lengthening of the loading cylinder or reduced in order to cause a shortening of the loading cylinder, and in such a way that a central axis C1 of the first cylinder member and a central axis C3 of the connecting member can be tilted to an angle relative to each other and relative to a central axis C2 of the second cylinder member as a result of a tilting of the press shoe during pressing. The lengths of stroke L1 and L2, the connecting member length L3, and geometrical positions of the contacting seals are such as to minimize an angle A2 between the central axis C3 of the connecting member and the central axis C2 of the second cylinder member during the tilting of the press shoe.

The press device in accordance with the invention preferably also includes at least one stopping member arranged on at least one of the first cylinder member and the connecting member so as to limit a maximum value of the first length of stroke L1.

Further objects of the present invention will become apparent from the following description, while the features enabling the further objects to be achieved are defined in the dependent claims.

BRIEF DESCRIPTION OF THE DRAWINGS

In the following, the invention will be described in greater detail with reference to the attached drawings, in which.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
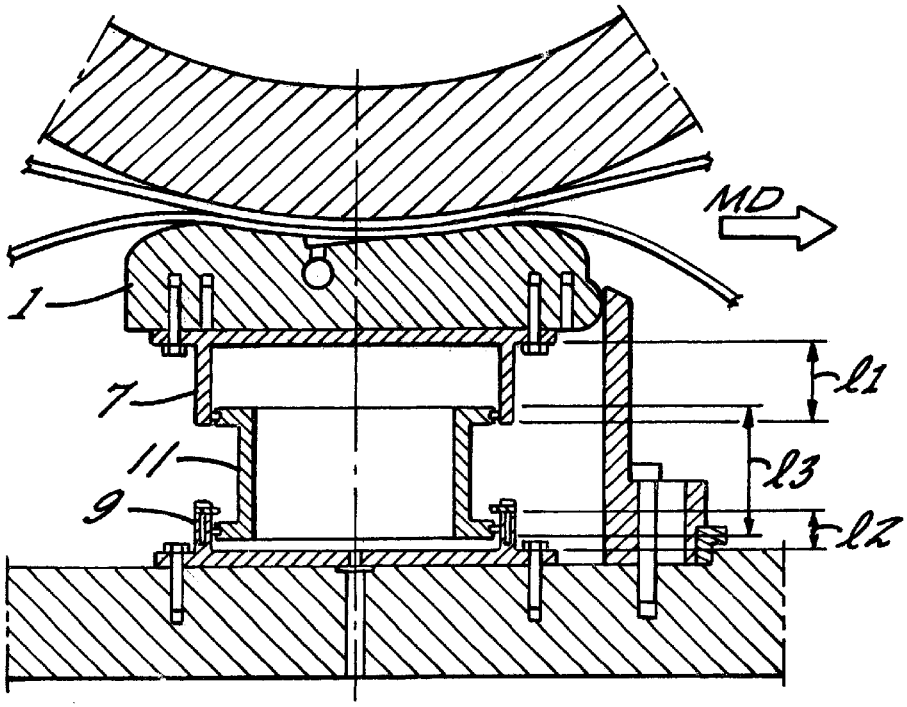
FIG. 1A shows a schematic sectional view seen across the machine direction of a shoe press device with its press shoe in a first position, intended to generate a substantially symmetrical pressure curve through the nip.
Figure 1B:
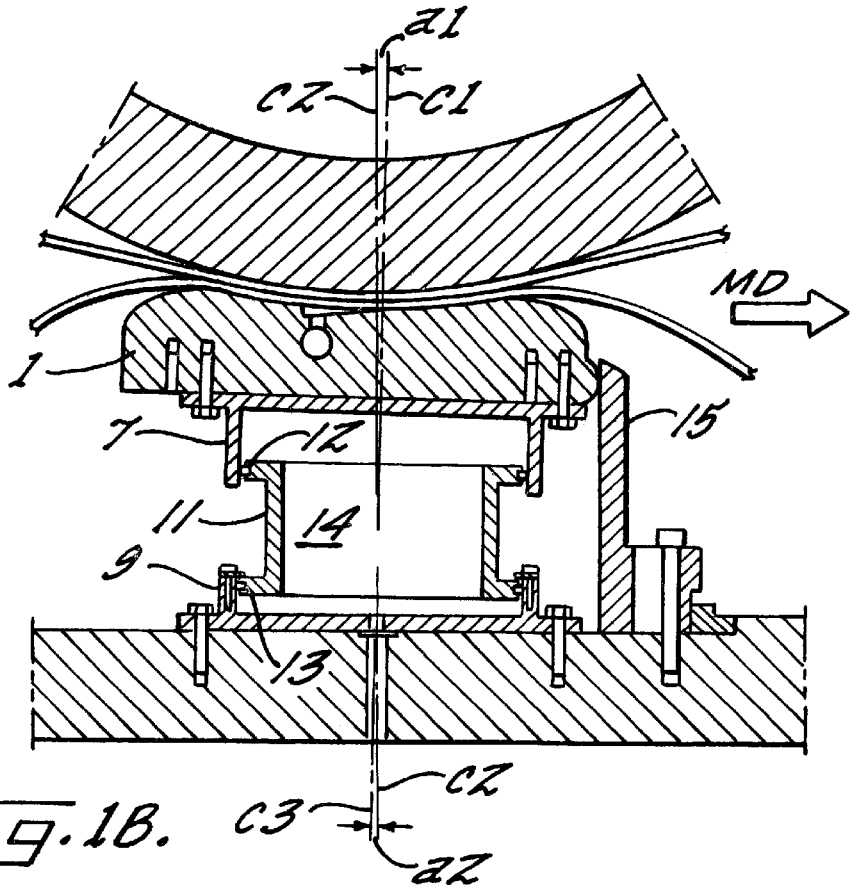
FIG. 1B shows the shoe press device in FIG. 1A with its press shoe intentionally moved into a second position, intended to displace the pressure maximum of the pressure curve toward the end of the nip in comparison to when the press shoe is in the first position shown in FIG. 1A.

For comparison, the attached FIGS. 1A and 1B show two different schematic sectional views, seen across the machine direction MD, of a shoe press device which will be discussed further in the following description.

Figure 2A:
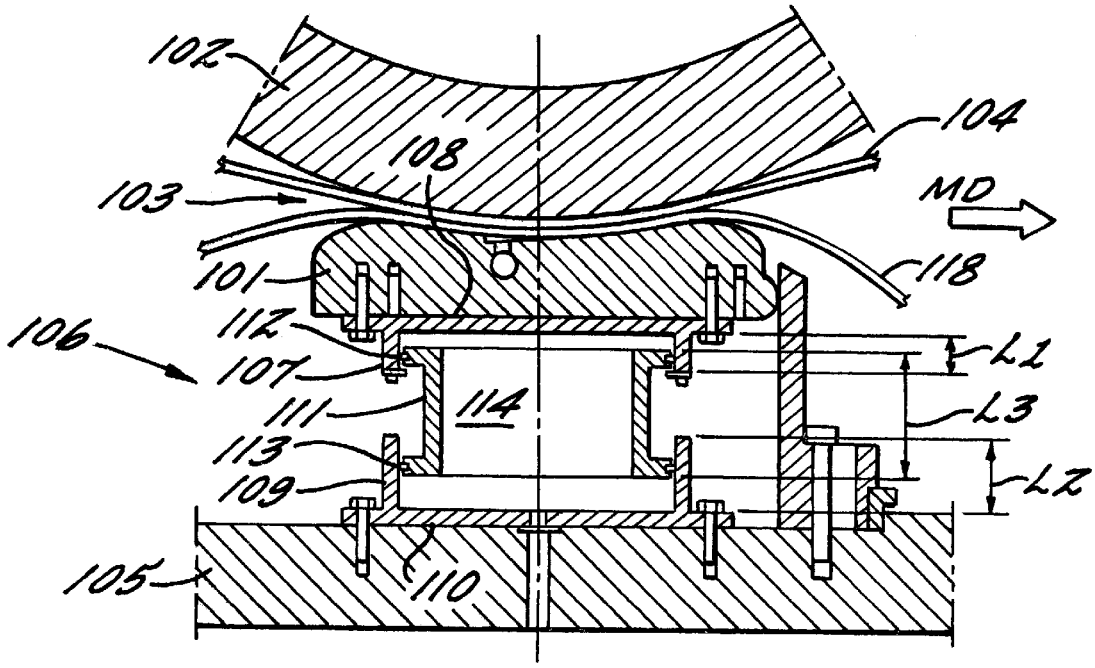
FIG. 2A shows a similar view as in FIG. 1A, but of a press device having an extended nip according to a preferred embodiment of the invention with its press shoe in a first position similar to the first position in FIG. 1A.
Figure 2B:
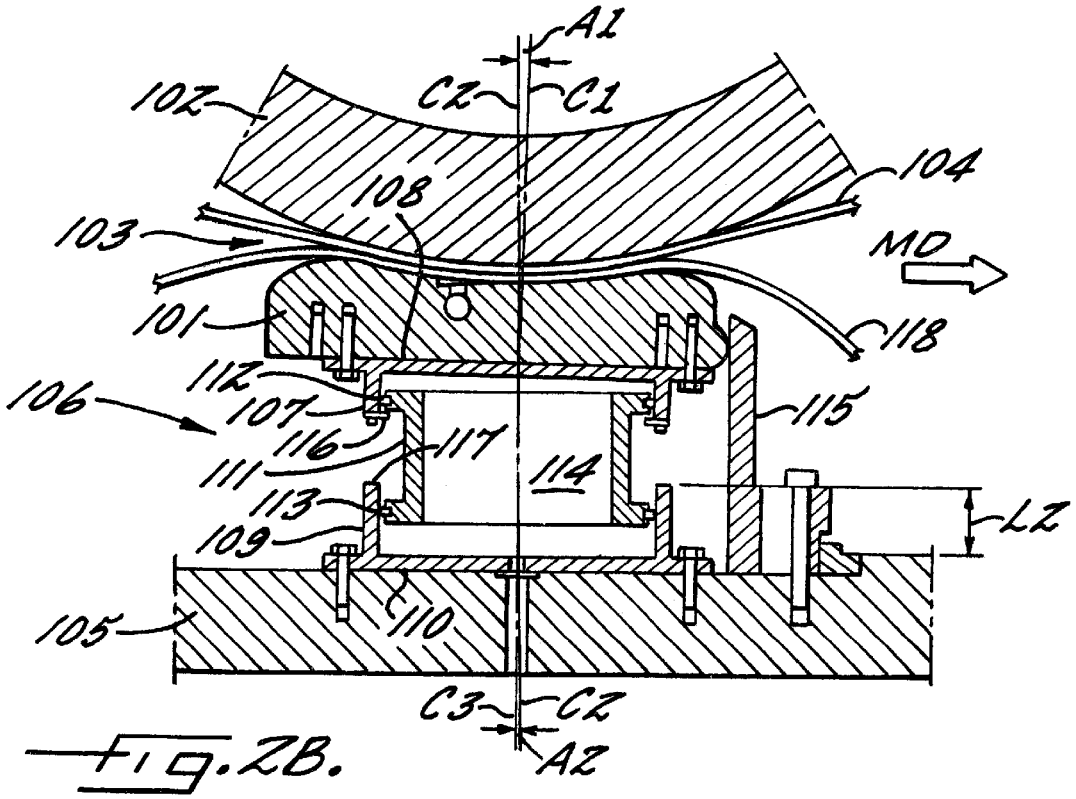
FIG. 2B shows the press device according to the invention in FIG. 2A, but now with its press shoe intentionally moved into a second position similar to the second position in FIG. 1B, FIG. 3 schematically shows the motion pattern of the cylinder members and the coupling member belonging to a loading cylinder of a shoe press device when lengthening the loading cylinder with its first cylinder member tilted to a certain angle, FIG. 4 schematically shows the motion pattern of the cylinder members and the connecting member belonging to a loading cylinder of a press device according to the invention when lengthening the loading cylinder with the first cylinder member tilted to the same angle as in FIG. 3.

In FIGS. 2A and 2B, similar views as in FIGS. 1A and 1B are shown, but of a press device having an extended nip according to a preferred embodiment of the invention.

The press device according to the invention is intended for pressing a running paper or paperboard web, and comprises a press shoe 101 aligned across the machine direction MD and arranged for forming an extended nip 103 in cooperation with a backing member 102 for passage of the web 104 during pressing.

The press device further comprises a support 105 which supports the press shoe in a movable way in a direction toward the backing member, via a plurality of loading cylinders 106 spaced apart along the press shoe 101 for enabling application of pressure on the web during pressing.

Each of the loading cylinders 106 comprises a first cylinder member 107 having a first cylinder end 108 which is attached to or integrated in the press shoe 101, and a second cylinder member 109 having a second cylinder end 110 which is attached to or integrated in the support 105.

The expression "cylinder member", as used herein, should be understood as a functional part of the loading cylinder, which can be of a hydraulic or pneumatic type. Examples of such "cylinder members" comprise internally or externally substantially cylindrical sleeves which are open in at least one end, substantially cylindrical solid bodies or pistons, or substantially cylindrical recesses in the press shoe or in the support.

The first and second cylinder members 107, 109 are slidably connected by a connecting member 111, wherein the connecting member 111 and the first cylinder member 107 are movable in relation to each other with a first length of stroke L1, while the connecting member 111 and the second cylinder member 109 are movable in relation to each other with a second length of stroke L2, and the connecting member has a third length L3.

The expression "length of stroke", as used herein, should be understood as the maximum length of a cylinder member available for sliding displacement of a second, cooperating member in relation to said cylinder member.

According to the invention and in the preferred embodiment, the first length of stroke L1 is smaller than the second length of stroke L2.

In a particularly preferred embodiment of the press device according to the invention, the first length of stroke L1 is less than half of the second length of stroke L2.

In another advantageous embodiment, the third length L3 is larger than both the first L1 and the second L2 length of stroke, wherein the third length L3 particularly advantageously is larger than the sum of the first L1 and the second L2 lengths of stroke.

In still another advantageous embodiment of the press device according to the invention, the connecting member 111 slidably connects the first 107 and the second 109 cylinder members in a sealed way by means of contacting seals 112, 113 in order to form at least one working chamber 114 within which the pressure of a pressurizing medium, such as hydraulic oil or pressurized air, can be reduced in order to generate a shortening or increased in order to generate a lengthening of the loading cylinder 106. Thereby, the connection is arranged in such a way that a central axis C1 of the first cylinder member 107 and a central axis C3 of the connecting member 111 can be tilted to an angle in relation to each other and to a central axis C2 of the second 109 cylinder member during an intentional or unintentional tilting of the press shoe 101 during pressing of the web. In this embodiment, the first L1 and second L2 lengths of stroke, the third length L3, and the geometrical positions of the contacting seals 112, 113 are adapted in order to minimize the angle A2 between the central axis C3 of the connecting member and the central axis C2 of the second cylinder member during the tilting.

The tilting of the press shoe can be either intentional or unintentional. The seals 112, 113 can advantageously be of the type disclosed in the above-discussed EP 0 933 471 corresponding to U.S. Pat. No. 6,083,352, which has been incorporated herein by reference. As will become evident from the following description, the connecting member can also have different geometrical shapes.

In still another advantageous embodiment of the press device according to the invention, particularly illustrated in FIG. 2B, a shoe support 115 is fixated to the support for receiving forces in the machine direction MD exerted by the press shoe 101 in contact with the shoe support during a pressing operation. In this embodiment, one or several stopping members 116 are arranged on the first cylinder member 107 and/or on the connecting member 111, in order to restrict a maximum value of the first length of stroke L1, and thereby ensure a very low angle A2 between the central axes C3 and C2. In the press device illustrated in FIGS. 2A and 2B, the stopping members 116 are constituted by a ring, screwed on the open end of the first cylinder member 107, and having a slightly smaller inside diameter than the diameter of the first cylinder member, wherein the ring 116 is intended to cooperate with the protruding seal 112 enclosing the connecting member 111. However, it is also conceivable in other embodiments of the shoe press device according to the invention for the stopping members to have another suitable design. In connection with this embodiment, it should be noted that the shoe press device illustrated in FIGS. 1A and 1B lacks stopping members for restricting the maximum value of its corresponding length of stroke 11.

In still another advantageous embodiment of the press device according to the invention, the first cylinder member 107 comprises an open third cylinder end 116 opposite the above-mentioned first cylinder end 108, while the second cylinder member 109 comprises an open fourth cylinder end 117 opposite the above-mentioned second cylinder end 110.

Figure 5A:
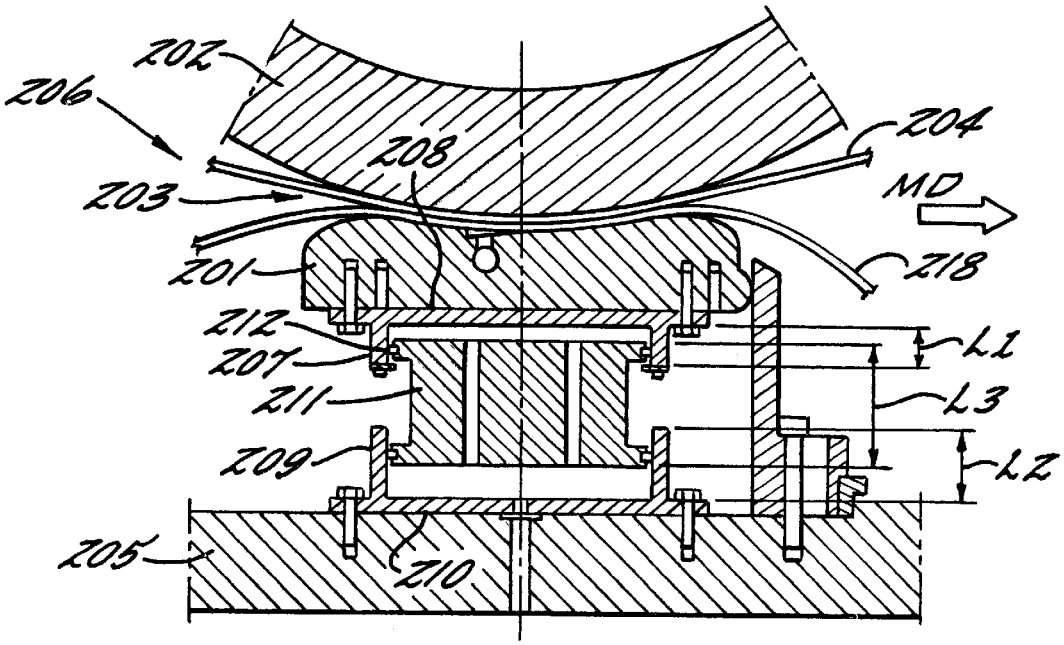
FIG. 5A depicts a press device in accordance with an alternative embodiment of the present invention.

In this embodiment, the third 116 and fourth cylinder ends 117 encircle a respective end of the connecting member 111 in order to form the working chamber 114 or several working chambers. Thereby, the connecting member 111 advantageously can be a substantially cylindrical sleeve, the interior of which constitutes a part of the working chamber 114, as illustrated in FIGS. 2A and 2B. In an alternative embodiment shown in FIG. 5A, the connecting member 211 instead is constituted of a solid, substantially cylindrical body. One end of the connecting member is engaged inside a hollow first cylinder member 207 affixed to the press shoe 201. The other end of the connecting member is engaged inside a hollow second cylinder member 209 affixed to the support 205. At each end of the connecting member 211 a working chamber is formed. One or several passages advantageously but not necessarily can be arranged between the two ends for pressure connection between the formed working chambers.

Figure 5B:
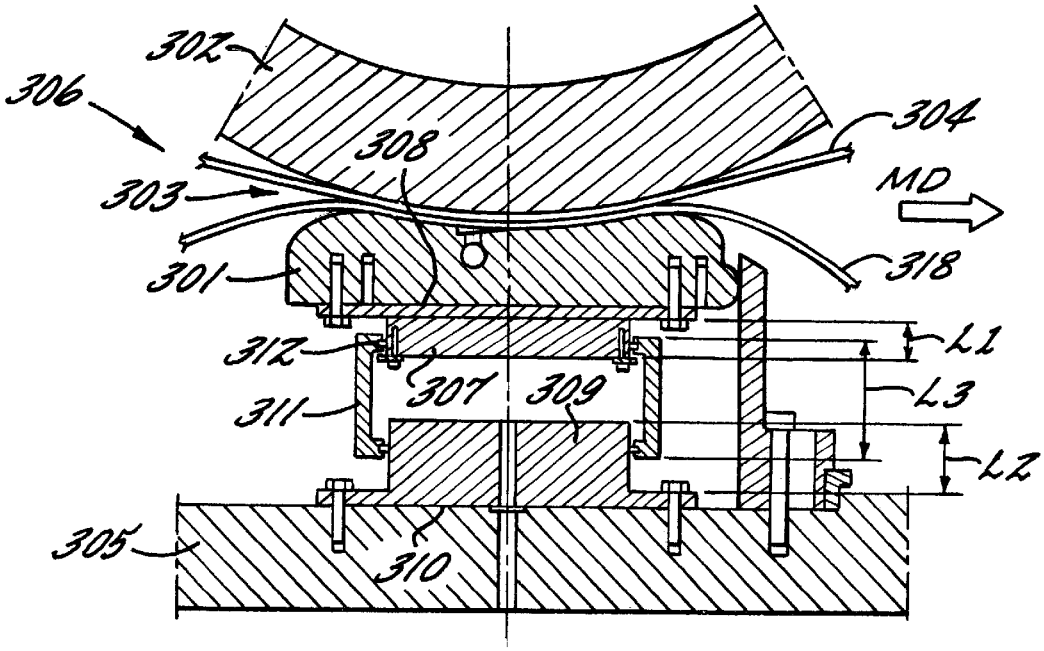
FIG. 5B depicts a press device in accordance with still another embodiment of the present invention.

In still another alternative embodiment of the shoe press device according to the invention as shown in FIG. 5B, each of the first and second cylinder members 307, 309 is a solid, substantially cylindrical body one end of which is enclosed by the connecting member 311 in order to form the working chamber. Thereby, the sealing means 312 should be arranged on the connecting member in order to make it possible to minimize its tilting/skewness in accordance with the invention.

It is particularly advantageous in accordance with the invention for the backing member 102 to be a rotatable counter roll, and the press device advantageously includes a flexible belt 118 arranged in an endless loop for running between the press shoe 101 and the paper or paperboard web 104 during pressing. Thereby, the flexible belt preferably has the shape of a sleeve.

The press device having an extended nip according to the invention preferably is intended for wet-pressing, or for calendering a paper or paperboard web.

In the following, some of the advantages that can be achieved in the practice of the present invention will be illustrated through an example.

FIG. 1A shows a shoe press device with its press shoe in a first position, intended to generate a substantially symmetrical pressure curve through the nip.

FIG. 1B shows the shoe press device in FIG. 1A, but now with its press shoe intentionally moved into a second position, which is intended to displace the pressure maximum of the pressure curve towards the end of the nip in comparison to when the press shoe is in the first position shown in FIG. 1A. As is evident from FIGS. 1A and 1B, the first length of stroke 11 of the illustrated shoe press device is larger than the second length of stroke 12.

Accordingly, the intentional displacement of the press shoe 1 into the second position shown in FIG. 1B is intended to displace the pressure maximum of the pressure curve towards the end of the nip, whereby the press shoe 1 and, consequently, the central axis c1 of the first cylinder member 7 associated therewith, will be tilted forwards in the machine direction MD to an angle al in relation to the central axis c2 of the second cylinder member 9. In this regard, it should be noted that the angles shown in the drawings, for reasons of clarity, have been exaggerated.

A large tilting of the connecting member (piston) 11 in the direction towards the shoe support 15 results in the shoe support 15 being subjected to large stresses during the pressing, since a force component is generated which will press against the first cylinder member 7 and, together with other forces directed forwards in the machine direction MD, will press the press shoe 1 against the shoe support 15.

FIGS. 2A and 2B instead illustrate a press device having an extended nip according to a preferred embodiment of the invention. FIG. 2A shows the press device with its press shoe in a first position similar to the first position in FIG. 1A, while FIG. 2B shows the press device with its press shoe intentionally moved into a second position similar to the second position in FIG. 1B.

In FIG. 2B, the press shoe 101 has been intentionally tilted approximately as much as the press shoe 1 in FIG. 1B in order to make it possible to obtain a higher nip pressure in the end of the nip than in its beginning. Accordingly, the angle A1 between the central axis C1 of the first cylinder member 107 and the central axis C2 of the second cylinder member 109 is approximately as large as the angle al in FIG. 1B. As a result of the different parts of the loading cylinder 106 being arranged in accordance with the invention, the angle A2 between the central axis C3 of the connecting member 111 and the central axis C2 of the second cylinder member 109 now becomes significantly smaller than the corresponding angle a2 between the central axes c2 and c3 in FIG. 1B. Starting from the examples above, it should be evident to the skilled person that the minimization, i.e., reduction or even elimination, of the angle A2 which is achieved by means of the present invention reduces or even eliminates the force components in the machine direction MD, originating from pressurization of the working chamber 114, which are exercised by the press shoe 101 on the shoe support 118.

Figure 3:
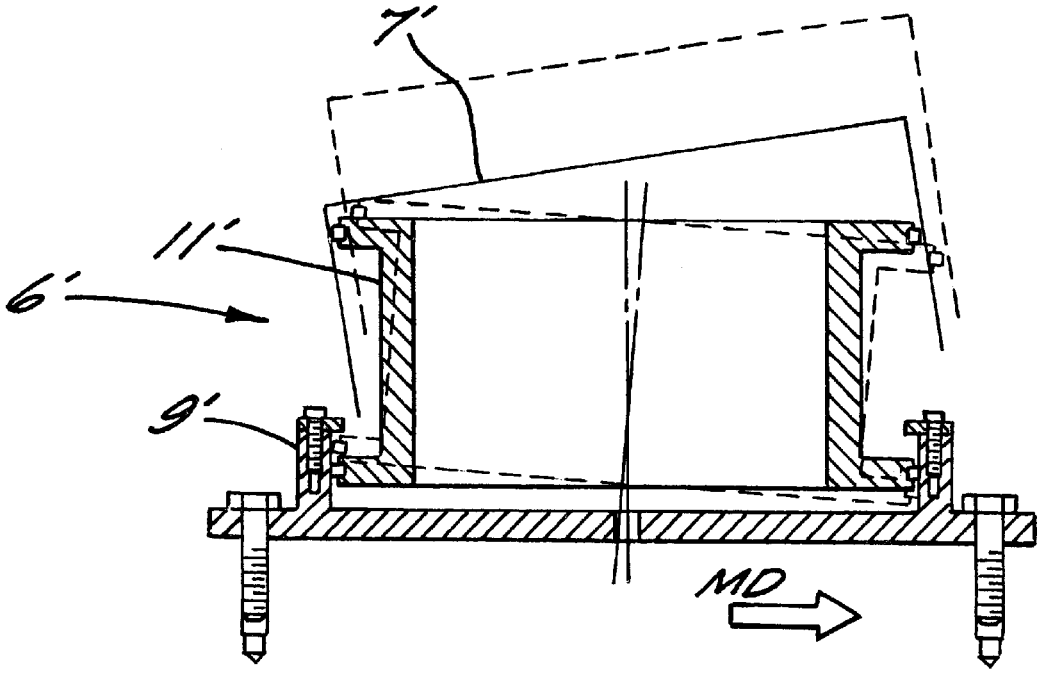

FIG. 3 schematically shows the motion pattern of the cylinder members 7', 9' and the connecting member 11 belonging to a loading cylinder 6' of a shoe press device when lengthening the loading cylinder with its first cylinder member tilted to a certain angle.

Figure 4:
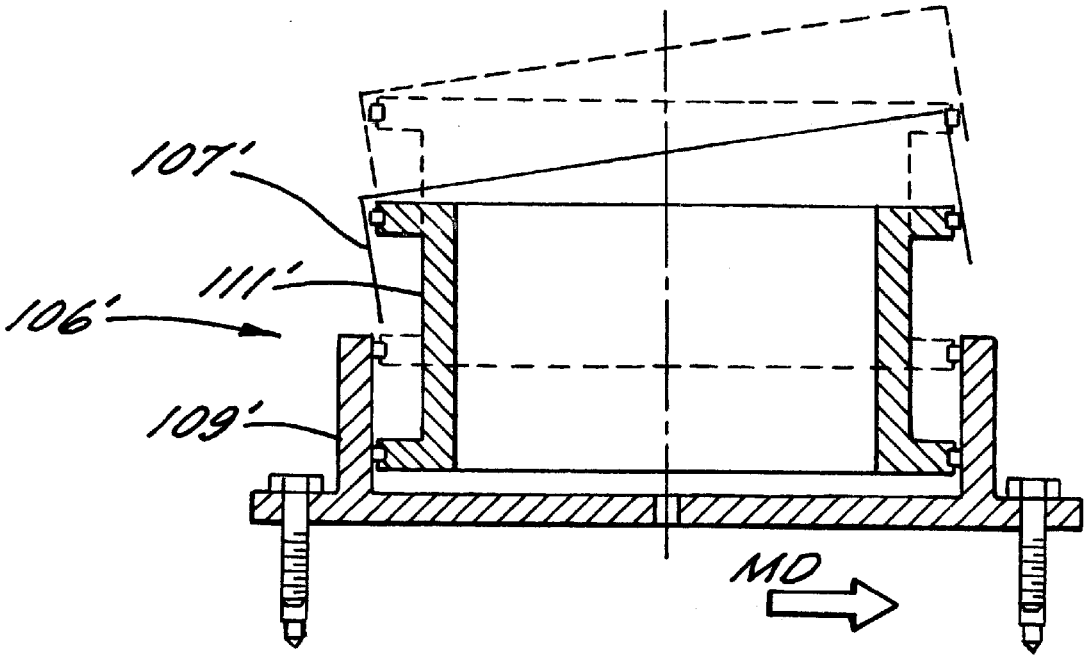

In contrast, FIG. 4 schematically shows the motion pattern of the cylinder members 107', 109' and the connecting member 111' belonging to a loading cylinder 106' of a press device according to the invention when lengthening the loading cylinder with the first cylinder member tilted to the same angle as in FIG. 3.

As is evident from FIG. 4, the press device according to the present invention enables the connecting member 111 to move substantially linearly and in parallel to the lengthening direction of the loading cylinder 106, when lengthening (or shortening) the loading cylinder 106'. This minimizes the stresses on a possible shoe support.

During the lengthening (or shortening) of a loading cylinder 6' of the shoe press device shown in FIG. 3, the connecting member 11' instead will be tilted with different angles in relation to the lengthening direction of the loading cylinder 6' depending on how far the lengthening or shortening course has proceeded. This can generate very large stresses on a possible shoe support, or result in the press shoe becoming unstable in case the forces are directed towards the machine direction (backward in the machine direction). Furthermore, the frictional force between the press shoe and the shoe support will vary in a direction across the machine direction, depending on the larger deflection of the support (beam) in the middle (and resulting larger skewness of the piston). This can cause cross-machine variations in the machine-directional pressure curve of the shoe press.

The mechanical and hydraulic, alternatively pneumatic, components which are in included in the shoe press device according to the invention have not been described in any greater detail herein, since such components should be well-known to the skilled person and also are disclosed and discussed in the above-mentioned EP 0 933 471.

Furthermore, it should be noted that the paper web 104 preferably is carried through the nip 103 by one or several water receiving machine clothings, such as one or several press felts.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A press device for pressing a web that is carried in a machine direction through an extended nip between the press device and a backing member, comprising:

a press shoe structured and arranged to be juxtaposed with the backing member to form said extended nip through which the web passes, the press shoe extending in a cross-machine direction along substantially a full width of the web;

a support that supports the press shoe such that the press shoe is movable in a loading direction toward the backing member for applying pressure to the web;

a plurality of loading cylinders spaced apart in the cross-machine direction along the press shoe, each loading cylinder comprising a first cylinder member fixed on the press shoe, a second cylinder member fixed on the support, and a connecting member slidably engaged with and extending between the first and second cylinder members, wherein the connecting member and the first cylinder member are slidable in relation to each other with a first maximum length of stroke L1, and the connecting member and the second cylinder member are slidable in relation to each other with a second maximum length of stroke L2, the connecting member has a length L3 in a direction corresponding to that along which the connecting member is slidable in relation to the first and second cylinder members, and wherein the first maximum length of stroke L1 is smaller than the second maximum length of stroke L2.

2. The press device of claim 1, wherein the first maximum length of stroke L1 is less than half of the second maximum length of stroke L2.

3. The press device of claim 1, wherein the length L3 of the connecting member is larger than both the first maximum length of stroke L1 and the second maximum length of stroke L2.

4. The press device of claim 1, wherein the length L3 of the connecting member is larger than the sum of the first maximum length of stroke L1 and the second maximum length of stroke L2.

5. The press device of claim 1, wherein the connecting member sealingly engages the first and second cylinder members by contacting seals arranged between the connecting member and each of the cylinder members so as to form at least one working chamber within which pressure of a pressurizing medium can be increased in order to cause a lengthening of the loading cylinder or reduced in order to cause a shortening of the loading cylinder, and in such a way that a central axis C1 of the first cylinder member and a central axis C3 of the connecting member can be tilted to an angle relative to each other and relative to a central axis C2 of the second cylinder member as a result of a tilting of the press shoe during pressing, and wherein the lengths of stroke L1 and L2, the connecting member length L3, and geometrical positions of the contacting seals are such as to minimize an angle A2 between the central axis C3 of the connecting member and the central axis C2 of the second cylinder member during said tilting.

6. The press device of claim 1, further comprising at least one stopping member arranged on at least one of the first cylinder member and the connecting member so as to limit a maximum value of the first length of stroke L1.

7. The press device of claim 1, wherein the first cylinder member has an end formed as a hollow cylindrical structure inside of which one end of the connecting member is slidably received, and wherein the second cylinder member has an end formed as a hollow cylindrical structure inside of which an opposite end of the connecting member is slidably received.

8. The press device of claim 7, wherein the connecting member comprises a hollow cylindrical structure having an open interior that forms a portion of a working chamber within which pressure of a pressurizing medium can be increased in order to cause a lengthening of the loading cylinder or reduced in order to cause a shortening of the loading cylinder.

9. The press device of claim 7, wherein the connecting member comprises a substantially solid cylindrical body each end of which bounds a working chamber within each of the cylinder members in which pressure of a pressurizing medium can be increased in order to cause a lengthening of the loading cylinder or reduced in order to cause a shortening of the loading cylinder.

10. The press device of claim 9, wherein the cylindrical body of the connecting member defines at least one passage connecting the working chamber in one of the cylinder members with the working chamber in the other cylinder member.

11. The press device of claim 1, wherein the first and second cylinder members each comprises a substantially solid cylindrical body and the connecting member is formed as a hollow cylindrical structure inside of which an end of each cylinder member is slidably received, whereby a working chamber is defined within the connecting member in which pressure of a pressurizing medium can be increased in order to cause a lengthening of the loading cylinder or reduced in order to cause a shortening of the loading cylinder.

12. The press device of claim 1, wherein the press device is structured and arranged for wet-pressing a paper or paperboard web.

13. The press device of claim 1, wherein the press device is structured and arranged for calendering a paper or paperboard web.

14. The press device of claim 1, further comprising a counter roll forming said extended nip with the press shoe, and a flexible belt for running between the web and the press shoe during pressing.

* * * * *